US006401917B1

(12) United States Patent
Smith

(10) Patent No.: US 6,401,917 B1
(45) Date of Patent: Jun. 11, 2002

(54) CONTAINER FOR FILM CARTRIDGES, PHOTOGRAPHS, NEGATIVES OR THE LIKE

(76) Inventor: Scott D. Smith, 1223 White Oak Dr., Hernando, MS (US) 38632

( * ) Notice: Subject to any disclaimer, the term of this patent is extended or adjusted under 35 U.S.C. 154(b) by 0 days.

(21) Appl. No.: 09/862,500

(22) Filed: May 23, 2001

Related U.S. Application Data

(63) Continuation-in-part of application No. 09/716,254, filed on Nov. 21, 2000.

(51) Int. Cl.[7] ..... B65D 75/00
(52) U.S. Cl. ..... 206/232; 206/455; 229/72
(58) Field of Search ..... 206/232, 449, 206/454, 455; 229/67.1, 67.4, 68.1, 68.2, 70–74, 76, 84; 383/106

(56) References Cited

U.S. PATENT DOCUMENTS

| | | | | | |
|---|---|---|---|---|---|
| 1,181,757 | A | * | 5/1916 | Forgue | 229/84 |
| 1,772,312 | A | * | 8/1930 | Hilbert | 229/84 |
| 2,499,528 | A | * | 3/1950 | Reitzes | 383/106 |
| 3,383,028 | A | * | 5/1968 | Brander | 229/84 |
| 4,047,661 | A | | 9/1977 | Klein | |
| 4,057,140 | A | | 11/1977 | Hutzel | |
| 4,629,070 | A | | 12/1986 | Roberg | |
| 4,653,639 | A | * | 3/1987 | Traynor | 229/72 |
| 4,836,382 | A | | 6/1989 | Schreiber | |
| 5,060,847 | A | | 10/1991 | Angus | |
| 5,103,972 | A | | 4/1992 | Ackeret | |
| 5,316,208 | A | * | 5/1994 | Petkovsek | 229/72 |
| 5,398,866 | A | * | 3/1995 | Bluemle | 229/68.1 |
| 5,431,449 | A | | 7/1995 | Arimoto et al. | |

* cited by examiner

*Primary Examiner*—Jim Foster
(74) *Attorney, Agent, or Firm*—Nixon & Vanderhye; Frank P. Presta

(57) ABSTRACT

A reclosable and collapsible container for articles such as film cartridges, photographs, negatives or the like, comprising a rear panel, a pair of front flaps foldably connected to the sides of the rear panel and extending laterally inwardly over the rear panel in spaced relation thereto, a front panel foldably connected to the bottom of the rear panel and extending upwardly over the front flaps, and a cover panel foldably connected to the top of the rear panel and extending in a closed position downwardly over the front panel. The rear panel, front flaps and front panel define a first compartment for film cartridges, photographs or the like. The front flaps and the front panel define between the overlapped portions thereof a second compartment in front of the first compartment for negatives or the like. The front panel is releasably connected to the front flaps, and the cover panel can be releasably connected to the front panel when in the closed position or when the container is to be maintained in a collapsed, folded condition for shipping or storage.

9 Claims, 3 Drawing Sheets

CONTAINER FOR FILM CARTRIDGES, PHOTOGRAPHS, NEGATIVES OR THE LIKE

CROSS REFERENCE TO RELATED APPLICATION

The present application is a continuation-in-part of application Ser. No. 09/716,254 filed on Nov. 21, 2000 now pending.

BACKGROUND OF THE INVENTION

The present invention relates to a reclosable container for articles such as photographs and the like and, more particularly, to such a container that provides separate compartments for articles such as film cartridges, photographs and negatives.

In the case of photographic products, particularly developed photographs for distribution to consumers, the traditional packaging is a flimsy paper envelope-type package which does not adequately protect the photographic products that are susceptible to damage by bending, scratching or tearing. Such envelope-type packages usually include the developed photographs and the negatives in one compartment. Also, such paper packages do not prevent the contents from deteriorating from exposure to moisture, and paper has an acid content that will damage photographic products stored therein.

The negatives are misplaced in many instances after the photographs are reviewed and stored in albums or the like, or the negatives are stored separately from the photographs and thus are difficult to locate or identify when additional prints are desired.

Accordingly, a need exists for a simple, strong, reusable package for dispensing and storing articles such as film cartridges, photographs and/or negatives in separate compartments in a safe condition. The new and improved container of the present invention meets this need. Also, because of its novel construction, the present container can be shipped and stored in a collapsed and substantially flat condition when not in use.

SUMMARY OF THE INVENTION

The reclosable container of the present invention is formed of any suitable material, preferably a clear plastic, flexible and resilient material, and generally comprises a rear panel of a size greater than the size of standard developed photographs. Foldably connected to the rear panel are a top panel, two side panels and a bottom panel, all of which are of substantially the same width that is large enough to accommodate film cartridges, a set of developed photographs and/or the negatives for same. A front panel is foldably connected to the outer edge of the bottom panel, and a cover panel is foldably connected to the outer edge of the top panel. Each side panel has a front flap foldably connected to the outer edge thereof.

In the assembled container, the top panel, side panels and bottom panel extend forwardly in generally perpendicular relation to the rear panel. The front flaps extend laterally inwardly in spaced and generally parallel relation to the rear panel, the front panel extends upwardly over the front flaps in spaced and generally parallel relation to the rear panel, and the cover panel extends downwardly over the front panel in spaced and generally parallel relation to the rear panel.

The assembled panels define a first or rear compartment for photographs, film cartridges or the like. The assembled front flaps and front panel define therebetween a narrow second or front compartment for negatives or the like. To maintain the container in assembled condition, the front panel has locking tabs that are removably received within slits at the fold lines between the front flaps and side panels. The cover panel has a locking tab that is removably received within a slit in the front panel.

To enable the container to be shipped or stored in a collapsed, folded, substantially flat condition, the front panel is provided with a third slit near the junction between the bottom panel and the front panel that is positioned to be engaged by the second locking tab in the cover panel. In the collapsed, substantially flat condition, the side panels and front flaps are folded over the rear panel in substantially parallel relation thereto, the bottom panel and front panel are folded over the side panels and front flaps in substantially parallel relation thereto, and the top panel and cover panel are folded over the bottom panel and front panel in substantially parallel relation thereto. The removable engagement of the second locking tab in the cover panel with the third slit maintains the container in this collapsed, folded and substantially flat condition for shipping or storage.

The container of the present invention, therefore, provides separate, safe compartments for film cartridges, photographs and/or negatives, is simple in construction, easy to store, ship and assemble, and easy to open and close. The negatives may be retained in the second or front compartment by the frictional engagement between the end portions of the negatives and the adjacent overlapped surfaces of the front flaps and front panel.

DESCRIPTION OF THE PREFERRED EMBODIMENTS

Figure 1:
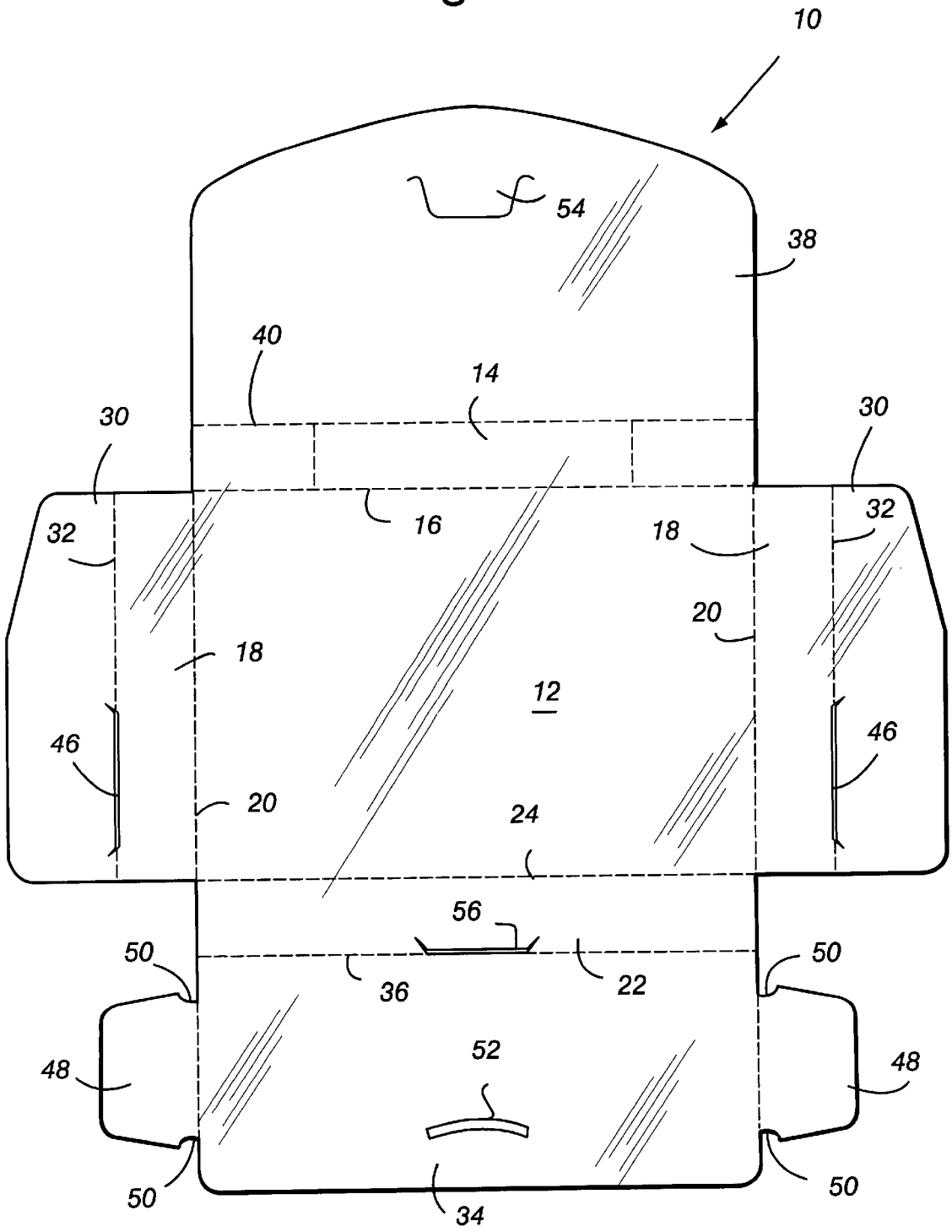
FIG. 1 is a plan view of the blank for the container of the present invention.

FIG. 1 illustrates a blank 10 for the collapsible and reclosable container of the present invention. Preferably, the blank 10 is of unitary construction and is formed of any suitable flexible and resilient, clear plastic material. Within the scope of the present invention, the blank 10 may be formed of any suitable material.

The blank 10 comprises a rear panel 12 that is of a size greater than the size of standard developed photographs or other articles intended to be placed in the container to be formed from the blank. A top panel 14 is connected to the rear panel 12 by a first fold line 16. Side panels 18 are connected to the sides of the rear panel 12 by second fold lines 20, and a bottom panel 22 is connected to the bottom of the rear panel 12 by a third fold line 24.

A pair of front flaps 30 are connected to the side panels 18 by fifth fold lines 32. A front panel 34 is connected to the bottom panel 22 by a sixth fold line 36, and a cover panel 38 is connected to the top panel 14 by a seventh fold line 40.

The fold lines 32 have first slits 46 therein that are adapted to be releasably engaged by laterally outwardly extending first locking tabs 48 on the front panel 34. The first locking tabs 48 preferably taper outwardly and are recessed at 50 near their inner ends to enable them to be snap-fitted in the first slits 46.

The front panel 34 has a second slit 52 in the mid-portion thereof that is adapted to be engaged by a second locking tab 54 on the cover panel 38 when it is moved to a closed position as hereinafter described.

Figure 2:
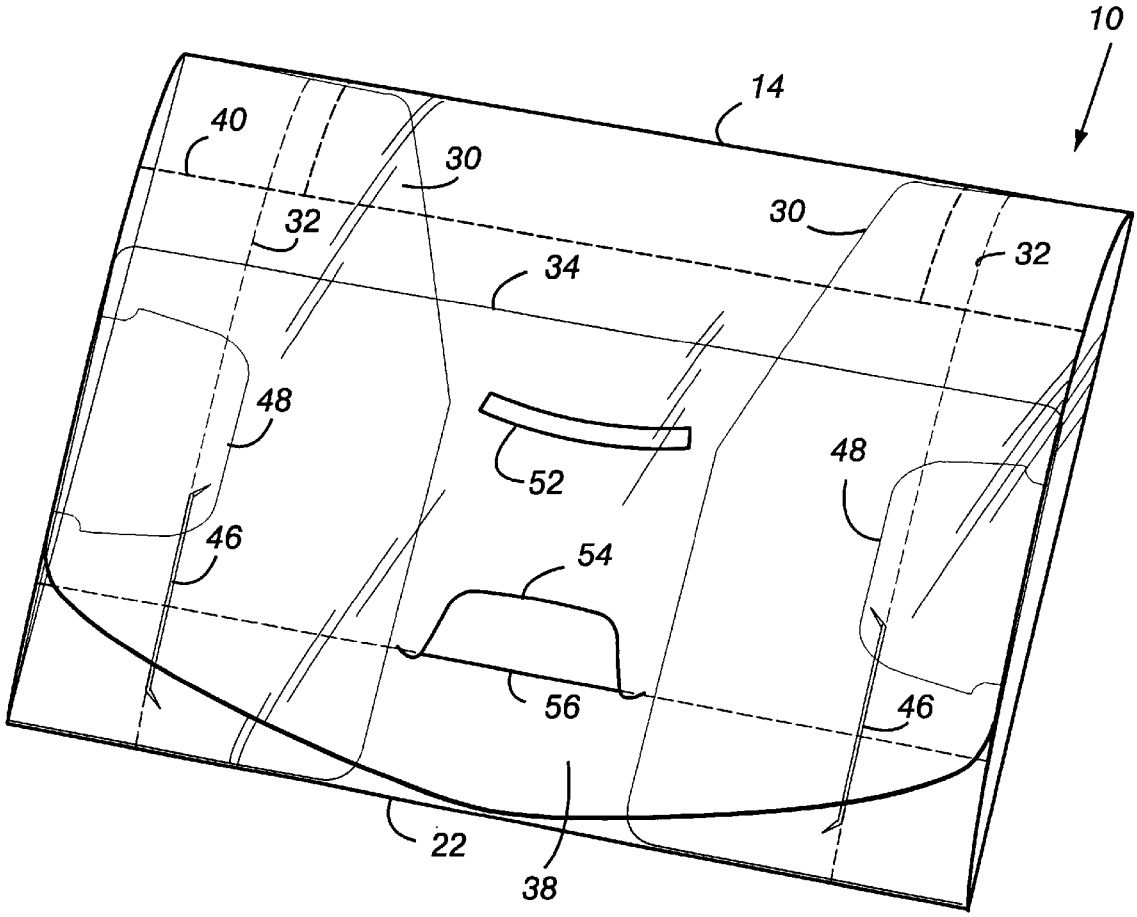
FIG. 2 is a front perspective view of the container of the present invention in collapsed, folded and substantially flat condition for shipping or storage.

To enable the container to be shipped or stored in the collapsed, folded, substantially flat condition shown in FIG. 2, the front panel 34 is provided with a third slit 56 near the sixth fold line 36 that is positioned to be engaged by the second locking tab 54 in the cover panel 38. In the collapsed, substantially flat condition, the side panels 18 and front flaps 30 are folded over the rear panel 12 in substantially parallel relation thereto, the bottom panel 22 and front panel 34 are folded over the side panels 18 and front flaps 30 in substantially parallel relation thereto, and the top panel 14 and cover panel 38 are folded over the bottom panel 22 and front panel 34 in substantially parallel relation thereto. The removable engagement of the second locking tab 54 in the cover panel 38 with the third slit 56 maintains the container in this collapsed, folded and substantially flat condition shown in FIG. 2 for shipping or storage.

It is noted that, within the scope of the present invention, the third slit 56 may be in any suitable location on the sixth fold line 36, the bottom panel 22 or the front panel 34, depending on the location of the second locking tab 54 in the cover panel 38.

Figure 3:
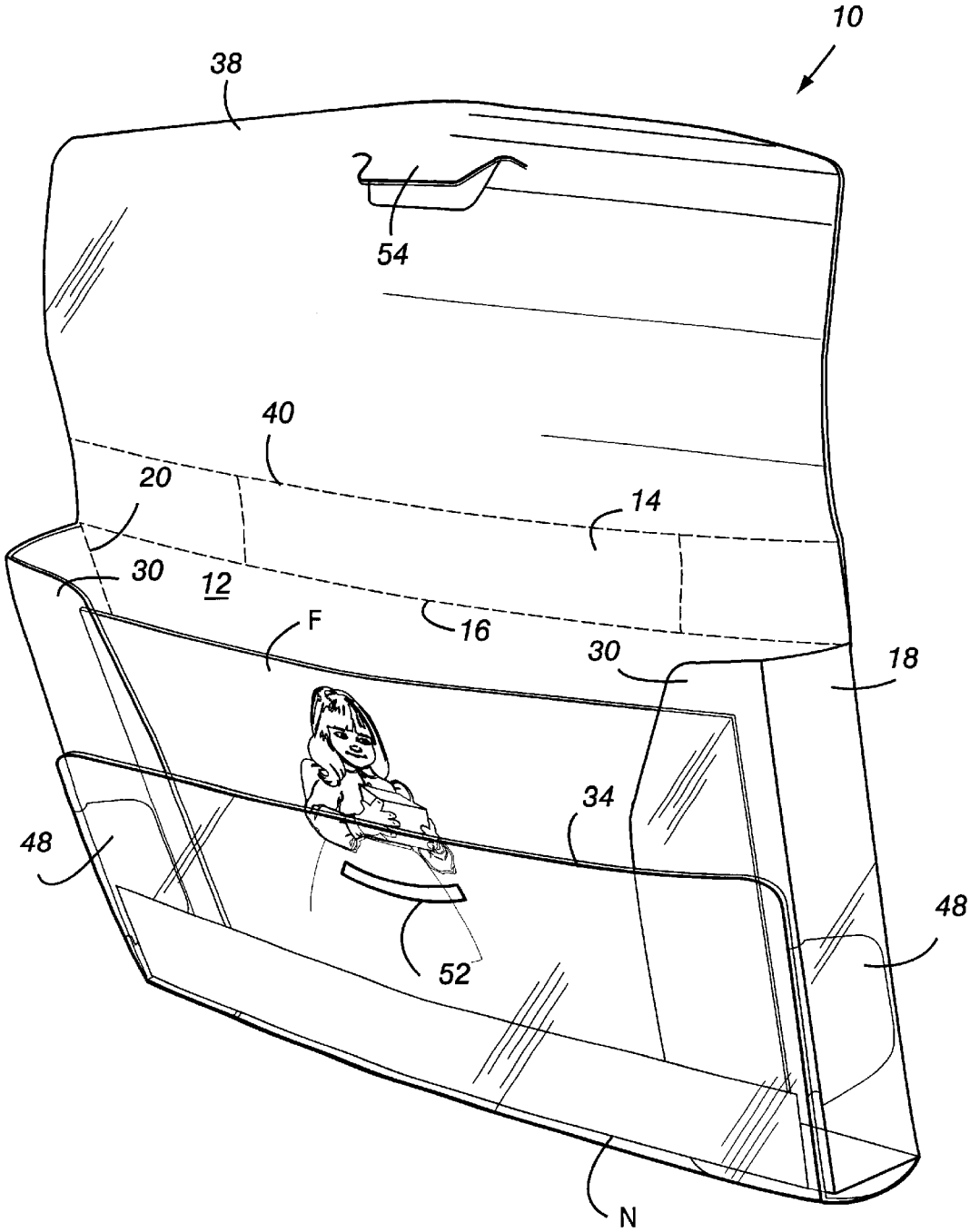
FIG. 3 is a perspective view of the container of the present invention in assembled form with film and negatives therein, and with the cover panel in an open position.

FIG. 3 illustrates the blank 10 in assembled position to form a container for articles such as film cartridges, photographs, negatives and the like. In the assembly of the container, the side panels 18 are first folded inwardly into substantially perpendicular relation to the rear panel 12 and the front flaps 30 are folded inwardly into substantially perpendicular relation to the side panels such that the front flaps are in substantially parallel relation to the rear panel 12.

Thereafter, the bottom panel 22 is folded inwardly into substantially perpendicular relation to the rear panel 12 and the front panel 34 is folded upwardly into substantially perpendicular relation to the bottom panel 22 such that it is generally parallel to the rear panel 12. In order to connect the front panel 34 to the front flaps 30, the first locking tabs 48 are folded inwardly and inserted into the first slits 46 in the fold lines 32 so as to be in releasable locking engagement therewith.

The rear panel 12, top panel 14, side panels 18, bottom panel 22, front flaps 30 and front panel 34 define a first compartment for holding articles such as film cartridges, photographs F or the like. The front flaps 30 and front panel 34 define in the overlapped portions thereof a narrow second compartment disposed in front of the first compartment for holding flat articles such as negatives N or the like as shown in FIG. 3.

To close the container 10, the top panel 14 is folded downwardly into substantially perpendicular relation with the rear panel 12 and the cover panel 38 is folded downwardly into substantially perpendicular relation with the top panel 14 such that it extends in substantially parallel relation to the rear panel 12. The second locking tab 54 of the cover panel 38 is inserted into the second slit 52 in the front panel 34 for releasable locking engagement therewith when the cover panel is moved into the closed position over the front panel 34. By releasing the second locking tab 54 from the second slit 52, the cover panel 38 can again be moved to the open position of FIG. 3 for access to the contents of the container.

From the foregoing description, it will be readily seen that the collapsible and reclosable container of the present invention can be easily formed from the blank 10 that is simple in construction and easy to manufacture. The container provides separate compartments for photographs and negatives stored therein and serves to enclose and protect the photographs and negatives therein. The plastic material of the container will protect the photographic materials stored therein from moisture and also is acid-free to further prevent deterioration of the photographic materials.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A collapsible and reclosable container for film cartridges, photographs, negatives and other articles, comprising:

a rear panel;

a pair of front flaps foldably connected to the sides of the rear panel and extending laterally inwardly over said rear panel;

a front panel foldably connected to the bottom of said rear panel and extending upwardly over said front flaps. and a cover panel foldably connected to the top of said rear panel and extending in a closed position downwardly over said front panel;

said rear panel, said front flaps and said front panel defining a first compartment; and said front flaps and said front panel defining between the overlapped portions thereof a second compartment in front of said first compartment;

said container having a first slit on or near said front panel, and said cover panel having a first locking tab that is releasably engageable with said first slit to maintain said container in a collapsed, substantially flat condition wherein said front flaps are closely adjacent to and substantially parallel with said rear panel said front panel is closely adjacent to and substantially parallel with said front flaps, and said cover panel is closely adjacent to and substantially parallel with said front panel;

side panels being disposed between and foldably connected to said rear panel and said front flaps, a top panel being disposed between and foldably connected to said rear panel and said cover panel and a bottom panel being disposed between and foldably connected to said rear panel and said front panel said side panels, said top panel and said bottom panel being, of substantially the same width;

wherein, when said container is in an assembled condition, said front flaps are substantially parallel to and spaced from said rear panel, said side panels are substantially perpendicular to said rear panel and said front flaps, said bottom panel is substantially perpendicular to said rear panel and said front panel, and said top panel is substantially perpendicular to said rear panel and said cover panel when said cover panel is in said closed position:

said front panel having a second slit therein, and said first locking tab oil said cover panel being removably engageable with said second slit when said cover panel is in said closed position and said container is in said assembled condition.

2. The container of claim 1 wherein, when the container is in said collapsed condition, said side panels are closely adjacent to and substantially parallel with said rear panel, said bottom panel is closely adjacent to and substantially parallel with said front flaps and side panels, and said top panel is closely adjacent to and substantially parallel with front flaps and said side panels.

3. The container of claim 1 wherein said front flaps said front panel and said cover panel are in substantially parallel relation to said rear panel when said cover panel is in said closed position.

4. The container of claim 1 wherein it is formed of unitary construction of a clear, flexible and resilient plastic material.

5. A flat blank for forming a collapsible and reclosable container for film cartridges, photographs. negatives and other articles comprising:

a rear panel, a pair of front flaps foldably connected to the sides of the rear panel and adapted to be folded laterally inwardly over said rear panel;

a front panel foldably connected to the bottom of said rear panel, and adapted to be folded upwardly over said front flaps when they arc folded over said rear panel; and a cover panel foldably connected to the top of said rear panel and adapted to be folded downwardly to a closed position over said front panel when it is folded upwardly over said front flaps:

said rear panel, said front flaps and said front panel being adapted to define a first compartment when folded over said real panel; and said front flaps and said front panel being adapted to define a second compartment in front of said first compartment when said front panel and said front flaps are folded in overlapping relation over said rear panel;

said blank having, a first slit on or near said front panel, and said cover panel having a first locking tab that is adapted to releasably engage said first slit to maintain the container in a collapsed, substantially flat condition wherein said front flaps are closely adjacent to and substantially parallel with said rear panel, said front panel is closely adjacent to and substantially parallel with said front flap, and said cover panel is closely adjacent to and substantially parallel with said front panel;

side panels being disposed between and foldably connected to said rear panel and said front flaps, a top panel being disposed between and foldably connected to said rear panel and said cover panel, and a bottom panel being disposed between and foldably connected to said rear panel and said front panel, said side panels, said top panel, and said bottom panel being of substantially the same width;

wherein said side panels, said bottom panel and said top panel are adapted to be folded inwardly, upwardly and downwardly, respectively, in substantially perpendicular relation to said rear panel, said front flaps are adapted to be folded laterally inwardly in substantially perpendicular relation to said side panel, said front panel is adapted to be folded upwardly into substantially perpendicular relation to said bottom panel, and said cover panel is adapted to be folded downwardly into substantially perpendicular relation to said top panel;

said front panel having a second slit therein, and said first locking tab of said cover panel being adapted for removable locking engagement with said second slit when said front panel and said cover panel are folded over said rear panel.

6. The blank of claim 5 wherein said rear panel, said top panel, said side panels, said bottom panel, said front flaps, said front panel and said cover panel are foldably connected by fold lines.

7. The blank of claim 5 wherein fold lines are disposed between said side panels and said front flaps, said fold lines having third slits therein and said front panel having second locking tabs on the sides there of adapted for removable locking engagement with said third slits when said front flaps and said front panel are folded inwardly over said rear panel.

8. The blank of claim 5 wherein it is formed of unitary construction of a clear, flexible and resilient plastic material.

9. A collapsible and reclosable container for film cartridges, photographs, negatives and other articles, comprising:

a rear panel;

a pair of front flaps foldably connected to the sides of the rear panel and extending laterally inwardly over said rear panel;

a front panel foldably connected to the bottom of said rear panel and extending upwardly over said front flaps; and a cover panel foldably connected to the top of said rear panel and extending in a closed position downwardly over said front panel:

said rear panel, said front flaps and said front panel defining a first compartment; and said front flaps and said front panel defining between the overlapped portions thereof a second compartment in front of said first compartment;

said container having a first slit on or near said front panel, and said cover panel having a first locking tab that is releasably engageable with said first slit to maintain said container in a collapsed, substantially flat condition wherein said front flaps are closely adjacent to and substantially parallel with said rear panel, said front panel is closely adjacent to and substantially parallel with said front flaps, and said cover panel is closely adjacent to and substantially parallel with said front panel;

side panels being disposed between and foldably connected to said rear panel and said front flaps, a top panel being disposed between and foldably connected to said rear panel and said cover panel, and a bottom panel being disposed between and foldably connected to said rear panel and said front panel, said side panels, said top panel and said bottom panel being of substantially the same width;

wherein, when said container is in an assembled condition, said front flaps are substantially parallel to and spaced from said rear panel, said side panels are substantially perpendicular to said rear panel and said front laps, said bottom panel is substantially perpendicular to said rear panel and said front panel, and said top panel is substantially perpendicular to said real panel and said cover panel when said cover panel is in said closed position;

fold lines being disposed between said side panels and said front flaps, said fold lines having second slits therein, and said front panel having second locking tabs on the sides thereof in removable locking engagement with said second slits when said container is in said assembled condition.

* * * * *